US007383682B2

(12) United States Patent
Kauss

(10) Patent No.: US 7,383,682 B2
(45) Date of Patent: Jun. 10, 2008

(54) HYDRAULIC CONTROL ARRANGEMENT FOR A MOBILE EQUIPMENT

(75) Inventor: Wolfgang Kauss, Francheville (FR)

(73) Assignee: Bosch Rexroth AG, Stuttgart (DE)

( * ) Notice: Subject to any disclaimer, the term of this patent is extended or adjusted under 35 U.S.C. 154(b) by 174 days.

(21) Appl. No.: 10/576,419

(22) PCT Filed: Nov. 22, 2004

(86) PCT No.: PCT/DE2004/002574

§ 371 (c)(1),
(2), (4) Date: Jun. 8, 2006

(87) PCT Pub. No.: WO2005/052380

PCT Pub. Date: Jun. 9, 2005

(65) Prior Publication Data

US 2007/0051100 A1 Mar. 8, 2007

(30) Foreign Application Priority Data

Nov. 25, 2003 (DE) ..... 103 54 959

(51) Int. Cl.
*F15B 1/02* (2006.01)
*E02F 9/22* (2006.01)

(52) U.S. Cl. ..... 60/469; 60/413

(58) Field of Classification Search ..... 60/413, 60/461, 469
See application file for complete search history.

(56) References Cited

U.S. PATENT DOCUMENTS

| | | | | |
|---|---|---|---|---|
| 4,969,562 | A * | 11/1990 | Saotome | 60/469 |
| 4,995,517 | A | 2/1991 | Saotome | |
| 5,245,826 | A * | 9/1993 | Roth et al. | 60/413 |
| 5,802,847 | A * | 9/1998 | Harnischfeger | 60/413 |
| 6,351,944 | B1 * | 3/2002 | Fertig et al. | 60/413 |
| 7,243,494 | B2 * | 7/2007 | Evans | 60/469 |
| 2004/0088972 | A1 * | 5/2004 | Harnischfeger et al. | 60/469 |

FOREIGN PATENT DOCUMENTS

| | | | |
|---|---|---|---|
| DE | 44 16 228 | A1 | 9/1995 |
| SU | 1270241 | A1 | 11/1986 |
| WO | WO 9817873 | A1 * | 4/1998 |

* cited by examiner

*Primary Examiner*—Thomas E Lazo
(74) *Attorney, Agent, or Firm*—Oliff & Berridge, PLC

(57) ABSTRACT

What is disclosed is a hydraulic control arrangement for a mobile equipment, such as for a backhoe loader or a wheel loader, wherein a working tool of the equipment is adapted to be actuated by means of a hydraulic cylinder whose pressure chambers may jointly be connected with a hydraulic accumulator 14 for attenuating pitching oscillations of the working tool.

7 Claims, 1 Drawing Sheet

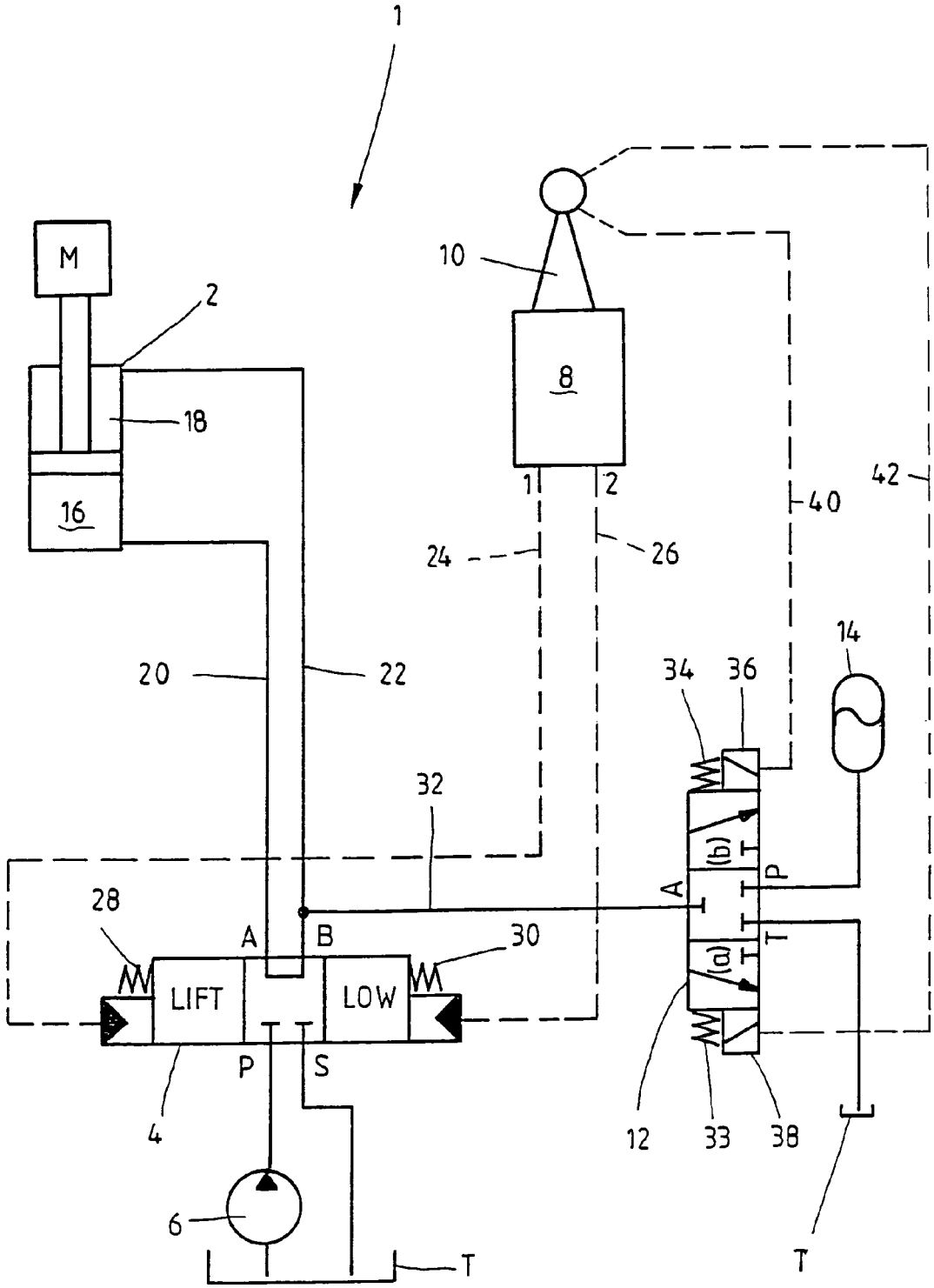
1
M
2
18
16
10
8
1
2
24
26
40
42
14
20
22
34
36
32
(b)
P
A
T
28
A
B
30
LIFT
LOW
(a)
P
S
4
12
33
38
6
T
T

HYDRAULIC CONTROL ARRANGEMENT FOR A MOBILE EQUIPMENT

The invention concerns a hydraulic control arrangement for a mobile equipment in accordance with the preamble of claim 1.

The like hydraulic control arrangements for a mobile equipment, such as a wheel loader, a backhoe loader, are employed for attenuating pitching oscillations. DE 44 16 228 A1 shows a hydraulic control arrangement wherein lifting cylinders of a loading shovel of a wheel loader are adapted to be provided with pressure medium through the intermediary of a directional control valve and an attenuation valve. Through the directional control valve the two pressure chambers of each lifting cylinder are connected with a pump or tank, respectively, in order to raise or lower the loading shovel. In a spring-biased center position of this directional control valve, the connections with the pressure chambers are blocked. In the neutral position of the directional control valve it is possible by means of the attenuation valve to connect either the pressure chambers of the lifting cylinders with a tank (floating position), or the pressure chambers (cylinder chambers) acting in the direction of supporting a load with a hydraulic accumulator and the other pressure chambers (annular chambers) with a tank, so that oscillations of the loading shovel may be attenuated. These pitching oscillations occur particularly with a filled loading shovel and at elevated travelling speeds.

The attenuation valve may be switched by the driver, or automatically, into the switching position of "pitching oscillation attenuation" as soon as pitching oscillations occur or once the travelling speed exceeds a predetermined limit value. The switching position of "floating" of the attenuation valve is set by the driver, e.g., if the loading shovel is to be dragged across the ground so as to level it.

It is a drawback in this solution that the attenuation valve has to be given a comparatively complex design, for in order to realize the two functions of "floating" and "pitching oscillation attenuation" it has to comprise two working lines that are connected with the lifting cylinders, and at least four ports (ports for the afore-mentioned working lines, tank port, port for hydraulic accumulator).

In contrast, the invention is based on the object of furnishing a hydraulic control arrangement for a mobile equipment wherein the functions of "floating" and "pitching oscillation attenuation" are enabled at low complexity.

This object is achieved by a hydraulic control arrangement for a mobile equipment in accordance with the preamble of claim 1.

In accordance with the invention, the hydraulic control arrangement comprises a directional control valve whereby the pressure medium flow between the pressure chambers of the hydraulic cylinder and a pump or a tank may be controlled. Associated to the directional control valve is an attenuation valve arrangement whereby both pressure chambers of the hydraulic cylinders may be connected with a hydraulic accumulator in order to switch to the function of "pitching oscillation attenuation."

I.e., as a difference from the prior art, not a pressure chamber is connected with the hydraulic accumulator and the other pressure chamber with the tank, but both pressure chambers are jointly subjected to the pressure in the hydraulic accumulator, so that the load acting on the hydraulic cylinder is basically supported only by the rod surface, i.e., the differential surface area of the piston bottom-side pressure chamber and the piston rod-side pressure chamber. Accordingly a comparatively high pressure acts in the direction of attenuation, whereby in a sense a high load is simulated, and correspondingly the pitching oscillation attenuation is more effective than in the prior art mentioned at the outset.

Another essential advantage resides in the fact that the attenuation valve arrangement needs to be realized with merely one work port, for in both functions of "pitching oscillation attenuation" and "floating", both respective pressure chambers of the hydraulic cylinder are subjected to a same pressure, i.e., the pressure in the hydraulic accumulator or the tank pressure.

The attenuation valve arrangement may moreover be realized with a low nominal width, for it is only passed through by a low pressure medium flow that corresponds to the volume displaced by the piston rod.

The hydraulic control arrangement may be simplified further if the directional control valve connects in its neutral position the delivery and drain lines leading to the two pressure chambers of the hydraulic cylinder, so that the work port of the attenuation valve arrangement has to be connected with the delivery or drain line by only a single attenuation line, whereby the expenditure for tubing is further reduced in comparison with the conventional solution.

In a particularly preferred embodiment of the invention, the attenuation valve is realized as a 3/3-way directional control valve, wherein the two inlet ports are connected with the hydraulic accumulator and the tank, respectively, and the work port with the attenuation line leading to the drain or delivery line. In the neutral position of the attenuation valve, these ports are blocked relative to each other, whereas in the two switching positions either the hydraulic accumulator or the tank is connected with the attenuation line. Instead of the 3/3-directional control valve it is also possible to use two 2/2-way directional control valves, with one being associated to the "floating" function, and the other one to the "pitching oscillation attenuation" function.

Control of the attenuation valve arrangement is preferably electric, wherein it is possible for the control signals to be output, e.g., by the driver operating switches of a pilot control device. Actuation of the directional control valve is preferably hydraulic by means of the mentioned pilot control device.

The hydraulic accumulator may have the form of a piston-type accumulator.

Further advantageous developments of the invention are subject matter of further subclaims.

FIG. 1 illustrates a schematic representation of a diagram of a hydraulic control arrangement according to this disclosure.

A preferred embodiment of the invention shall in the following be explained by referring to a schematic representation showing a diagram of the hydraulic control arrangement.

The hydraulic control arrangement 1 in accordance with the invention is used, e.g., in order to provide two lifting cylinders of a loading shovel of a wheel loader or backhoe loader with pressure medium. The switching diagram exemplarily only shows a lifting cylinder 2 whose pressure chambers are adapted to be connected via a directional control valve 4 with a pump 6 or a tank T. Control of the directional control valve 4 is performed with the aid of a hydraulic pilot control device 8 through the operation of a joystick 10 by the driver of the mobile equipment. In order to attenuate pitching oscillations or adjust a floating position, the pressure chambers of the lifting cylinders 2 may be connected via an attenuation valve 12 with a hydraulic accumulator 14 or the tank T. The attenuation valve 12 is controlled electrically and may be operated through the intermediary of switches arranged on the joystick 10.

The lifting cylinders 2.supporting the loading shovel have the form of differential cylinders, wherein in the figure the weight of the loading shovel and the load received in it are marked with an M. The piston bottom-side cylinder chamber 16 of the lifting cylinder 2 is connected via a delivery line 20 with a work port A, and an annular chamber 18 is connected via a drain line 22 with a work port B of the directional control valve 4. The latter has, e.g., the form of a proportionally adjustable directional control valve, wherein in the positions of a regulator (not shown) designated by "LIFT", a pump port P connected with the pump 6 is connected with the work port A, while the work port B is connected with a tank port S connected with the tank T, so that the pump 6 conveys pressure medium into the cylinder chamber 16, and pressure medium is displaced from the annular chamber 18 into the tank T—the load M is raised, with the velocity depending on the path of the regulator and/or the pumping capacity of the pump 6.

In the positions of the regulator designated by "LOW", the load M is lowered as the cylinder chamber 16 is connected with the tank T and the annular chamber 18 is connected with the pump 6.

As was already mentioned, the directional control valves 4 are controlled hydraulically through the intermediary of control lines 24, 26, whereby the control surfaces of the regulator may be subjected to a control pressure difference so as to shift the regulator into the desired position. These control pressures are generated through the hydraulic pilot control device 8, whereby a system control pressure may be reduced, with the aid of pressure reducing valves operable in dependence on the position of the joystick 10, to the desired control pressure that may be tapped at the control ports 1, 2 of the pilot control device 8. The function of such hydraulic pilot control devices is known, so that further explanations may be omitted.

The regulator of the directional control valve 4 is biased by springs 28, 30 into a center position in which the two work ports A, B are connected with each other and the two inlet ports P and S are blocked. I.e., in this center position the two pressure chambers 16, 18 of the lifting cylinder 2 are connected with each other.

In the represented embodiment the attenuation valve 12 has the form of a 3/3-way directional control valve, wherein an outlet port or work port A is connected via an attenuation line 32 with the drain line 22. A tank port T of the attenuation valve 12 is connected with the tank T, and a pressure port P is connected with a hydraulic accumulator 14. The valve spool of the attenuation valve 12 is biased by centering springs 33, 34 into a neutral position wherein the three ports A, T, P are blocked relative to other.

In the represented embodiment, the attenuation valve 12 is controlled electrically, with actuation of the valve spool being effected through the intermediary of solenoids 36, 38 connected via signal lines 40, 42 with switches on the joystick 10. The attenuation valve 12 is executed as a switching valve, wherein in its switching position designated by (a) the work port A is connected with the tank port T, so that both the annular chamber 18 and the pressure chamber 16 are connected with the tank T while the directional control valve 4 is not operated—the switching position designated by (a) thus represents the "floating" function in which the loading shovel practically rests on the ground by nothing but its own weight and the carried load so as to follow irregularities of the ground during levelling.

In the switching position designated by (b), the work port A is connected with the pressure port P, so that the pressure in the hydraulic accumulator 14 is present in both pressure chambers 16, 18. In this switching position the load M is supported by the pressure force equivalent corresponding to the piston rod surface, with a comparatively high pressure acting in the cylinder chamber 16, so that a higher load is "simulated" than in conventional solutions in which the annular chamber is relieved towards the tank T. This higher pressure permits a more effective attenuation of pitching oscillations.

In this position, pressure medium may be shifted back and forth between the cylinder chamber 16 and the annular chamber 18, with only the pressure medium quantity corresponding to the changing piston rod volume flowing across the attenuation valve 12. Owing to this comparatively low pressure medium flow rate, the attenuation valve 12 may be executed with a lower nominal width than in conventional solutions. The attenuation valve 12 may—in accordance with the above discussion—change over into its "pitching oscillation attenuation" function through operation of a switch; in principle it is also possible to automatically switch to this function once a certain travelling speed has been reached or the oscillation amplitude exceeds a predetermined maximum value.

In order to raise or lower the loading shovel, the attenuation valve 12 is switched back into its neutral position by de-energizing the solenoids 36, 38, and the directional control valve 4 is placed by means of the pilot control device 8 into one of its "LIFT" or "LOW" positions for extending or retracting the lifting cylinders 2.

Instead of the 3/3-way directional control valve employed in the embodiment, the attenuation valve 12 may also be realized by two 2/2-way directional control valves, wherein one is associated to the "floating" function, and the other one to the "pitching oscillation attenuation" function. The hydraulic accumulator 14 preferably has the form of a piston-type accumulator as the latter is particularly well suited for high pressures.

As a matter of fact, the attenuation line 32 may also be connected to the delivery line 20. In principle the connection of the two pressure chambers 16, 18 may also be integrated into the attenuation valve 12.

What is disclosed is a hydraulic control arrangement for a mobile equipment, such as for a backhoe loader or a wheel loader, wherein a working tool of the equipment is adapted to be actuated by means of a hydraulic cylinder whose pressure chambers may jointly be connected with a hydraulic accumulator 14 for attenuating pitching oscillations of the working tool.

| List of Reference Symbols: | |
|---|---|
| 1 | control arrangement |
| 2 | lifting cylinder |
| 4 | directional control valve |
| 6 | pump |
| 8 | pilot control device |
| 10 | joystick |
| 12 | attenuation valve |
| 14 | hydraulic accumulator |
| 16 | cylinder chamber |
| 18 | annular chamber |
| 20 | delivery line |
| 22 | drain line |
| 24 | control line |
| 26 | control line |

-continued

| List of Reference Symbols: | |
|---|---|
| 28 | spring |
| 30 | spring |
| 32 | attenuation line |
| 33 | centering spring |
| 34 | centering spring |
| 36 | solenoid |
| 38 | solenoid |
| 40 | signal line |
| 42 | signal line |

The invention claimed is:

1. Hydraulic control arrangement for a mobile equipment, comprising a directional control valve whereby the pressure chambers of a hydraulic cylinder may be connected via a drain and a delivery line with a tank or with a hydraulic pump, respectively, and comprising an attenuation valve arrangement whereby the pressure chambers may be connected with the tank or with a hydraulic accumulator for attenuation of oscillations and for adjusting a floating position, characterized in that the pressure chambers of the hydraulic cylinder are both connected with the hydraulic accumulator in the attenuation position.

2. The control arrangement in accordance with claim 1, wherein the delivery and drain lines are connected with each other in a center position of the directional control valve, and a work port of the attenuation valve arrangement is connected via an attenuation line with the delivery or drain line.

3. The control arrangement in accordance with claim 2, wherein the attenuation valve arrangement is a 3/3-way directional control valve having a neutral position in which the work port is blocked relative to the hydraulic accumulator and the tank, and having two switching positions in which the work port is connected with the tank or with the hydraulic accumulator.

4. The control arrangement in accordance with claim 3, wherein the attenuation valve arrangement is adapted to be actuated electrically through the intermediary of a pilot control device.

5. The control arrangement in accordance with claim 1, wherein the attenuation valve arrangement comprises two 2/2-way directional control valves whereby in an opened position a connection with the tank or with the hydraulic accumulator, respectively, may be controlled open.

6. The control arrangement in accordance with claim 1, wherein the directional control valve is adapted to be actuated hydraulically through the intermediary of a pilot control device.

7. The control arrangement in accordance with claim 1, wherein the hydraulic accumulator is a piston-type accumulator.

* * * * *